United States Patent [19]

Stewart et al.

[11] Patent Number: 5,055,208

[45] Date of Patent: Oct. 8, 1991

[54] FIRE EXTINGUISHING COMPOSITIONS

[75] Inventors: Harry E. Stewart, Malvern; Donald B. MacElwee, Wayne, both of Pa.

[73] Assignee: Powsus, Inc., Malvern, Pa.

[21] Appl. No.: 636,773

[22] Filed: Jan. 2, 1991

[51] Int. Cl.[5] ..... A62D 1/00

[52] U.S. Cl. ..... 252/8; 252/7; 169/44; 169/45; 169/46

[58] Field of Search ..... 252/7, 8, 8.05; 169/46, 169/44, 45

[56] References Cited

U.S. PATENT DOCUMENTS

| | | | |
|---|---|---|---|
| 2,653,130 | 5/1951 | Eiseman, Jr. | 252/8 |
| 2,821,257 | 1/1958 | Buckley | 169/31 |
| 3,106,530 | 10/1963 | Glew | 252/8 |
| 3,276,999 | 10/1966 | Petit | 252/8 |
| 3,480,545 | 11/1969 | Dale | 252/2 |
| 4,459,213 | 7/1984 | Uchida et al. | 252/8.05 |
| 4,908,161 | 3/1990 | Ashida | 252/609 |
| 4,920,154 | 4/1990 | Munstrey et al. | 521/131 |

*Primary Examiner*—Robert L. Stoll
*Assistant Examiner*—Nina Bhat
*Attorney, Agent, or Firm*—Kane, Dalsimer, Sullivan, Kurucz, Levy, Eisele and Richard

[57] ABSTRACT

Fire-extinguishing compositions of low ozone depletion potential comprise dry powder extinguishing agents and bromodichloromethane or dichlorotrifluoroethane.

9 Claims, No Drawings

FIRE EXTINGUISHING COMPOSITIONS

BACKGROUND OF THE INVENTION

1. Field Of the Invention

The invention relates to non-aqueous fire-extinguishing compositions useful in extinguishing Class A, Class B and Class C fires.

2. Brief Description of the Prior Art

The literature is replete with descriptions of fire-extinguishing compositions. Included in such compositions are dry chemicals for smothering flames and inhibiting oxidation (for example sodium and potassium bicarbonate) and vaporizing organic liquids (halogenated hydrocarbons). The latter compounds smother flames very effectively. Their popularity has led to the extensive use of chlorofluorocarbons as volatile, vaporizing organic liquids in flame suppression. Unfortunately, the chlorofluorocarbons have the potential for destroying ozone in the upper stratosphere, when released into the environment. This impact on the environment has been of great concern.

Recently, some 90 countries participated in a treaty to phase out use of the ozone-destroying chlorofluorocarbons such as those widely used in commercial applications including as fire suppressants. Thus, there is a need for fire-extinguishing compositions which substitute for the chlorofluorocarbons as an effective flame suppressor. However, the substitute must be as effective, if not better than the chlorofluorocarbons in flame suppression.

We have found fire-extinguishing compositions of low ozone depletion potential which are highly effective in extinguishing Class B and C fires and some are also useful to extinguish Class A fires as defined by the National Board of Fire Underwriters.

SUMMARY OF THE INVENTION

The invention comprises a non-aqueous, fire-extinguishing composition of low ozone depletion potential, which comprises; a non-aqueous gelled dispersion of a dry powder fire-extinguishing agent in a liquid selected from the group consisting of bromodichloromethane and dichlorotrifluoroethane.

The composition of the invention is useful in extinguishing Class A, B and C fires and particularly useful in extinguishing grease fires on stove tops, where a pan of grease has ignited.

The term "low ozone depletion potential" as used herein means a value of less than about 0.5 as determined by the method of Fisher et al., Nature, Vol. 344, pages 508–512 (April 5, 1990).

DETAILED DESCRIPTION OF THE PREFERRED EMBODIMENTS OF THE INVENTION

Dry powder fire-extinguishing agents in commercial use are of two principal types. One type is represented by sodium bicarbonate, potassium bicarbonate, ammonium borate, potassium borate, sodium borate (borax), sodium sulfate, sodium phosphate, sodium polyphosphate, sodium chloride, potassium chloride and the like. The second type may be represented by monoammonium phosphate, ammonium polyphosphate and the like. The fire-extinguishing compositions of the present invention preferably comprise a mixture of sodium or potassium bicarbonate and a boron-containing compound, preferably sodium borate. The mixture is advantageously in a weight ratio of from about 1:1 to 4:1, most preferably 3:1 (bicarbonate: Boron containing compound).

The dry-powder fire-extinguishing agents are advantageously provided in the form of free-flowing powders having finely divided particles, the average particle size being within the range of from about 0.1 to 500 microns, preferably 0.1 to 100 microns, most preferably less than 50 microns.

The dry powder fire-extinguishing agents are uniformly and homogeneously dispersed in the liquid bromodichloromethane or dichlorotrifluoroethane. Bromodichloromethane is a vaporizing liquid fire-extinguishing agent, having a vapor pressure of 57 PSIG at 25° C. Most importantly, bromodichloromethane has a low ozone depletion potential (OPD) of 0.19 and dichlorotrifluoroethane has an OPD of about 0.02 (method of Fisher et al., supra.).

The bromodichloromethane and/or the dichlorotrifluoroethane need not be present in the compositions of the invention as the sole liquid carrier for the dry fire-extinguishing powders. Other gelable organic liquid fire-extinguishers (preferably non-polar) may be present and in certain combinations have certain advantages, for example, the volatility of bromodichloromethane is relatively low. Volatile liquids of greater volatility and greater critical vapor pressure such as trifluoromethane and the like when added to the compositions of the invention will increase the overall vapor pressure of the compositions. Volatile liquids of lesser volatility then bromodichloromethane such as methylchloroform, methyliodide, ethyliodide, methylene chloride, dichlorobromopropane, ethylene dibromide, 1,1-dichloro-2,2,2-trifluoroethane and the like, when added to the compositions of the invention will serve to decrease the overall critical vapor pressures. The proportion of volatile liquid in the compositions of the invention may range from about 30 to about 75 percent by weight of the total composition, preferably 40 to 60 percent. In general, at least about 50 percent by weight of the volatile liquid fire extinguisher agent will be bromodicloromethane or dichlorotrifluoroethane as the essential ingredient.

Gelling agents for use in gelling non-aqueous dispersions of dry powdered fire-extinguishing agents in organic liquids are well known and include for example pyrogenic silica (such as the commercially available CAB-O-SiL® H5 marketed by G.L. Cabot, Inc., Boston, Ma.; pyrogenic alumina (such as Alan C®); carboxymethyl cellulose, carogeenin, polycarboxylated vinyl polymers such as described in U.S. Pat. No. 4,652,383, incorporated herein by reference thereto guar gum and the like. A preferred gelling agent is fumed silica/alumina (COKE® 84; DeGussa, Inc., Teterboro, New Jersey).

The gelling agents are present in the compositions of the present invention in an amount sufficient to effect gelatin of the liquid ingredients. Gelation is preferably the formation of a thixotrope, having a yield stress of at least about 200 dynes per $cm^2$.

The compositions of the invention may be containerized within containers having the structural strength for withstanding the pressures developed during storage and ambient use temperatures. Generally, these pressures will be within the range of from about 15 to 250 PSIG at room temperatures. Representative of such containers are those described in the U.S. Pat. No. 3,402,665. The container loading is facilitated by cooling the compositions of the invention below their critical vapor pressures, during loading.

The container compositions of the invention may also be overpressured to facilitate discharge, with non-flammable gases such as nitrogen, carbon dioxide, helium, argon and like gases, using conventional techniques.

The following examples and preparations describe the manner and process of making and using the invention and set forth the best mode contemplated by the inventors of carrying out the invention but are not to be construed as limiting the invention. Where reported, the following tests were carried out.

TEST PROCEDURE A (UL Standard 711)

A square pan having an area of 2.5 square feet was filled with gasoline over a bed of water, to within 6" of the upper lip of the pan. The gasoline was ignited and allowed to burn for 60 seconds before attempting to extinguish the flame. Extinguishing the fire in less than 5 seconds earns a 1-B fire rating.

TEST PROCEDURE B

Frying pans of 12 inch diameter were charged to a depth of 1½ inches with a vegetable oil. The oil was heated with an open propane flame, as a fuel, to a temperature of about 700° F. and allowed to self ignite. The compositions undergoing test (400 gms) were then applied to the fire with an aerosol type container fitted with a valve and a 0.093" diameter round actuator. The container was held at a distance of about 18 inches from the oil fire. The time to extinguish the oil flame is reported.

TEST PROCEDURE C

A circle having a diameter of 0.84 meters is established with unleaded gasoline (regular octane) and ignited. Passing the test requires extinction of the fire in less than 3 seconds.

TEST COMPOSITIONS

Example 1

A composition is prepared containing 160 gms of potassium bicarbonate, dispersed in 232 gms. of bromodichloromethane and 8 gms of trifluoromethane and gelled with 0.5 percent by weight of Coke®-84 (fumed silica/alumina, DeGussa). A test fire according to Test Procedure A, supra., was extinguished in 3.5 seconds.

Example 2

To 50 lbs. of bromodichloromethane there was mixed 2 lbs. of trifluoromethane to obtain a liquid fire suppressant having a vapor pressure of 100 PSIA at room temperature. To 275 gms. of the mixture there was added 125 gms. of monoammonium phosphate and 1 gm of Coke ®-84, supra., gellant. A test fire according to Test Procedure A, supra., was extinguished in less than 5 seconds.

Example 3

A mixture of 120 gms. of a mixture of sodium bicarbonate and sodium borate (3:1 ratio by weight) and 240 gms. of dichlorotrifluoroethane is gelled with 1 percent by weight of Coke®-84, supra.

When tested according to Test Procedure B, supra., the flame was extinguished in less than 3 seconds.

It was noted that in respect to Example 3, the presence of the sodium borate ingredient caused a reaction to occur at the interface of the burning oil and the extinguishing composition. A pasty, foam-like crust formed at the interface, which settled on the oil to rapidly extinguish the flame. The thick crust covered the oil surface to prevent a re-ignition of the hot oil.

Example 4

A composition is prepared containing 0.89 kilo of monoammonium phosphate dispersed in 1.1 kilo of bromodichloromethane gelled with 1 percent by weight of Coke ®-84, Degussa, supra. The composition is loaded into an aerosol type container and pressurized with nitrogen gas. When tested according to Test Procedure C, supra., the fire is extinguished in less than 2 seconds. The test procedure was repeated 2 additional times from the single charge.

Example 5

The procedure of Example 4, supra., was repeated, except that the diameter of the fire in Test Procedure C was increased to 2 meters. The fire was extinguished utilizing the whole charge of composition.

Examples 6 and 7

The procedures of Examples 1 and 2, respectively, are repeated except that the bromodichloromethane as used therein is replaced with an equal weight proportion of dichlorotrifluoroethane. The test results are similar.

What is claimed is:

1. In a non-aqueous fire-extinguishing composition which consists essentially of;

a dry powder fire-extinguishing agent dispersed in an organic liquid fire-extinguishing agent, the improvement which comprises;

employing a liquid agent, selected from the group consisting of bromodichloromethane and dichlorotrifluoroethane.

2. The composition of claim 1 which is a thixotropic gel.

3. A non-aqueous, fire-extinguishing composition of low ozone depletion potential, which consists essentially of; a non-aqueous gelled dispersion of a dry powder fire-extinguishing agent in a liquid selected from the group consisting of bromodichloromethane and dichlorotrifluoroethane.

4. The composition of claim 3 wherein the dry powder is selected from the group consisting of sodium bicarbonate, monoammonium phosphate, ammonium polyphosphate, potassium bicarbonate, sodium borate and mixtures thereof.

5. The composition of claim 4 wherein the dry powder is a mixture of sodium bicarbonate and sodium borate in a weight ratio of from about 1:1 to 4:1.

6. The composition of claim 3 wherein the dry powders have average particle diameters of from about 0.1 to 500 microns.

7. The composition of claim 3 which further consists of a volatile organic liquid fire-extinguishing agent having a critical vapor pressure greater or less than that of bromodichloromethane.

8. The composition of claim 7 wherein the additional liquid agent is 1, 1, 1-trichloromethane.

9. The composition of claim 3 wherein the gelling agent is fumed silica/alumina.

* * * * *